United States Patent [19]

Swift

[11] Patent Number: 4,835,807

[45] Date of Patent: Jun. 6, 1989

[54] CLEANING BRUSH

[75] Inventor: Joseph A. Swift, Ontario, N.Y.

[73] Assignee: Xerox Corporation, Stamford, Conn.

[21] Appl. No.: 149,341

[22] Filed: Jan. 28, 1988

[51] Int. Cl.[4] ..... G03G 21/00

[52] U.S. Cl. ..... 15/1.5 R; 15/179; 15/256.5; 15/256.52; 355/15

[58] Field of Search ..... 15/1.5, 256.52, 179; 355/15

[56] References Cited

U.S. PATENT DOCUMENTS

| | | | |
|---|---|---|---|
| 3,572,923 | 3/1971 | Fisher | 355/15 |
| 3,689,117 | 9/1972 | Hules | 300/21 |
| 3,722,018 | 3/1973 | Fisher | 15/1.5 |
| 3,823,035 | 7/1974 | Sanders | 117/226 |
| 4,207,376 | 6/1980 | Nagayasu et al. | 428/367 |
| 4,255,487 | 3/1981 | Sanders | 428/368 |
| 4,265,990 | 5/1981 | Stlka et al. | 430/59 |
| 4,319,831 | 3/1982 | Matsui et al. | 355/15 |
| 4,361,922 | 12/1982 | Karal | 15/256.52 |
| 4,388,370 | 6/1983 | Ellis et al. | 428/368 |
| 4,494,863 | 1/1985 | Laing | 355/15 |
| 4,706,320 | 11/1987 | Swift | 15/256.52 |

FOREIGN PATENT DOCUMENTS 56-154415 2/1981 Japan .

*Primary Examiner*—Edward L. Roberts

[57] ABSTRACT

A cleaning brush for electrostatographic reproducing apparatus has electroconductive fibers of nylon filamentary polymer substrate have finely divided electrically conductive particles of carbon black suffused through the surface of the filamentary polymer substrate and being present inside the filamentary polymer substrate as a uniformly dispersed phase independent of the polymer substrate in an annular region located at the periphery of the filament and extending inwardly along the length thereof. The electrically conductive carbon black is present in an amount sufficient to render the electrical resistance of the fiber from about $1\times10^3$ ohms per centimeter to about $1\times10^9$ ohms per centimeter. In a preferred embodiment, the fibers form the cut plush pile of a cut plush pile woven fabric which is wound spirally on a cylindrical core and includes conductive yarns spaced 2 to 3 centimeters apart running substantially parallel to the strip edges.

14 Claims, 3 Drawing Sheets

CLEANING BRUSH

BACKGROUND OF THE INVENTION

The present invention relates to cleaning brushes and in particular to electrostatic cleaning brushes for use in electrostatographic reproducing apparatus.

In electrostatographic reproducing apparatus commonly used today a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternatively, a light beam may be modulated and used to selectively discharge portions of the charged photoconductive surface to record the desired information thereon. Typically, such a system employs a laser beam. Subsequently, the electrostatic latent image on the photoconductive insulating surface is made visible by developing the image with developer powder referred to in the art as toner. Most development systems employ developer which comprises both charged carrier particles and charged toner particles which triboelectrically adhere to the carrier particles. During development the toner particles are attracted from the carrier particles by the charged pattern of the image areas of the photoconductive insulating area to form a powder image on the photoconductive area. This toner image may be subsequently transferred to a support surface such as copy paper to which it may be permanently affixed by heating or by the application of pressure.

Commercial embodiments of the above general processor have taken various forms and in particular various techniques for cleaning the photoreceptor have been used. One of the most common and commercially successful cleaning technique has been the use of a cylindrical brush with soft bristles such as rabbit fur which has suitable triboelectric characteristics. The bristles are soft so as the brush is rotated in close proximity to the photoconductive surface to be cleaned, the fibers continually wipe across the photoconductive surface to produce the desired cleaning.

Subsequent developments in cleaning techniques and apparatus in addition to relying on the physical contacting of the surface to be cleaned to remove the toner particles also rely on establishing electrostatic fields by electrically biasing one or more members of the cleaning system by establishing a field between a conductive brush and the insulative imaging surface so that the toner on the imaging surface is attracted to the brush. Thus, if the toner on the photoreceptor is positively charged then the field would be negative. The creation of the electrostatic field between the brush and imaging surface is accomplished by applying a DC voltage to the brush. Typical examples of such techniques are described in U.S. Pat. Nos. 3,572,923 to Fisher et al. and 3,722,018 to Fisher. A further refinement of these electrostatic brush cleaning devices is described in U.S. Pat. No. 4,494,863 to Laing wherein in addition to establishing an electric field between the imaging member and the brush to attract charged toner particles from the imaging member, a pair of detoning rolls, one for removing toner from the biased cleaner brush and the other for removing debris such as paper fibers and clay from the brush are provided. The two detoning rolls are electrically biased so that one of them attracts toner from the brush while the other one attracts debris thereby permitting toner to be used without degradation of copy quality while the debris can be discarded.

In all the brush cleaning systems, a balance between cleaning performance the removal of toner from a delicate imaging member, versus wearing abrasion and filming on the imaging member must be maintained at all times. The electrostatic brush techniques such as those described by Fisher, Fisher et al and Laing have the benefit in that the brush may be rotated relatively slowly and as a result the process speed may be increased while maintaining cleaning brush speed at the same relative rate. A further problem with abrasion may be present with the advent of photoconductive materials which are not as resistant to abrasion as materials of the past. For example, photoreceptors of the type disclosed in U.S. Pat. No. 4,265,990 to Stolka et al. which is directed to photoconductors comprising an electrically conductive substrate, a charge generator layer with photoconductive particles dispersed therein in an insulating organic resin and a charge transport layer are particularly susceptible to a abrasion damage by pure mechanical brush cleaners.

Initially, electrostatic brush cleaning devices employed brushes made with metal fibers such as stainless steel fibers because of their ready availability. While effective for some applications, they suffer certain deficiencies in that in addition to being relatively abrasive there is a tendency for the stainless steel fibers to entangle and compression set thereby causing premature shortfalls in cleaner performance. Furthermore, since the fibers are highly conductive if any one filament comes into contact with the ground surface, it would short out the whole brush providing a generalized cleaning failure. In addition, of course, loose fibers would short out other electrical elements such as corotrons, switches, etc. Finally, since stainless steel fibers are sold on a weight basis, they become very costly in comparison to other fibers having a much lower specific gravity. Accordingly, there has been a desire and a need to provide an alternative more economical, long life, stable fiber.

PRIOR ART

U.S. Pat. No. 4,319,831 to Matsui et al. describes a cleaning brush for a copying device wherein the brush is composed of composite conductive fibers consisting of at least one conductive layer containing conductive fine particles and at least one non-conductive layer in a mono filament. The fiber diameter is less than 30 denier per filament, the fiber length is 5 to 30 millimeters. The electrical resistance of the conductive fibers is less than $10^{15}$ ohms/centimeter. Conductive carbon black particles may be used with a number of synthetic resins including polyamides.

SUMMARY OF THE INVENTION

In accordance with the present invention, a cleaning brush for use in electrostatographic reproducing apparatus has been provided. These brushes comprise electroconductive fibers wherein the individual brush fibers comprise a nylon filamentary polymer substrate having finely divided electrically conductive particles of carbon black suffused through the filamentary polymer substrate and being present inside the filamentary polymer substrate as a uniformly dispersed phase independent of the polymer substrate in an annular region located at the periphery of the filament and extending inwardly along the length thereof. The electrically conductive carbon black is present in an amount sufficient to render the electrical resistance of the fiber from about $1\times10^3$ ohms per centimeter to about $1\times10^9$ ohms per centimeter.

In a specific aspect of the present invention, the fibers are the cut plush pile of a cut plush pile woven fabric.

In a further aspect of the present invention, the fabric is in the form of a fabric strip which is spirally wound and bound to the surface of a cylindrical core.

In a further aspect of the present invention, the fabric strip includes one or more conductive yarns spaced about 2 to 3 centimeters apart running substantially parallel to the strip edges.

In a further aspect of the present invention, the brush has fiber fill density of from about 20,000 to about 50,000 fiber per square inch of about 5 to about 25 denier per filament fibers and a pile height of from about 6 millimeters to about 20 millimeters..

In a further aspect of the present invention, the brush is electrically biased to a polarity opposite to that of the charge on the toner.

BRIEF DESCRIPTION OF THE DRAWINGS

The above aspects of the present invention will become apparent as the following description proceeds upon reference to the drawings in which.

DETAILED DESCRIPTION OF THE PREFERRED EMBODIMENT

For a general understanding of the features of the present invention, a description thereof will be made with reference to the drawings.

Figure 1:
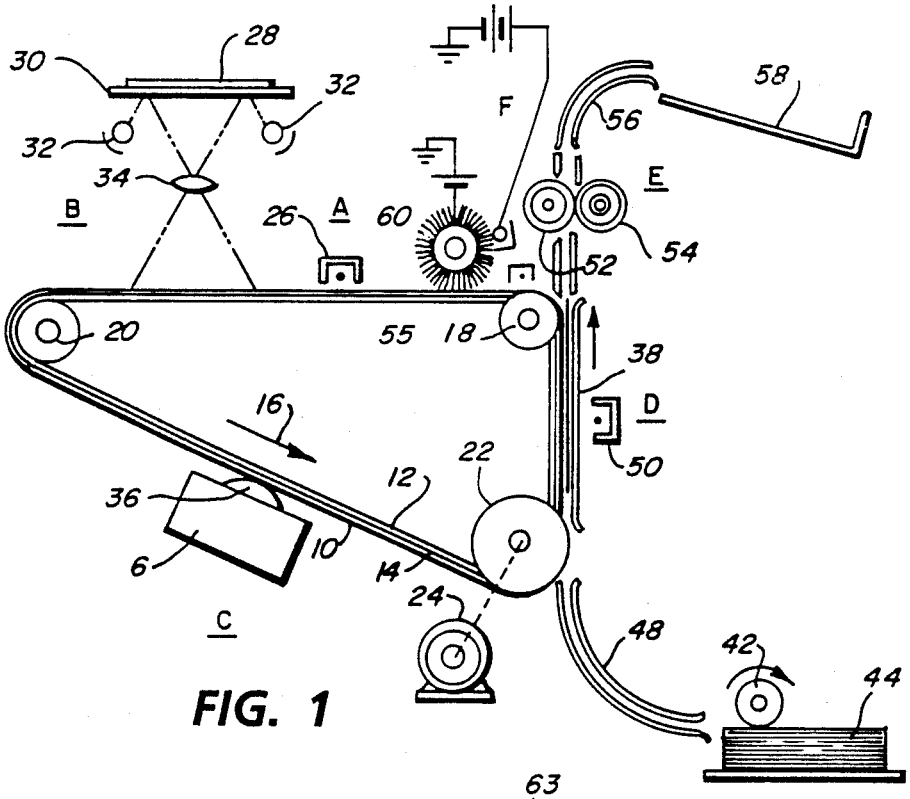
FIG. 1 is a schematic representation of electrostatographic reproducing apparatus incorporating the cleaning brush of the present invention.

FIG. 1 schematically depicts the various components of an illustrative electrostatographic printing machine incorporating an electrostatic brush cleaner according to the present invention. Inasmuch as the art of electrophotographic printing is well known, the various processing stations employed in the printing machine illustrated in FIG. 1 will be described very briefly. In FIG. 1, the printing machine utilizes a photoconductive belt 10 which consists of an electroconductive substrate 12 over which there is a photoconductive insulating imaging layer 14. The belt moves in the direction of arrow 1 to advance successive portions thereof sequentially through the various processing stations arranged about the path of movement thereof. Belt 10 is entrained about stripping roller 18, tensioning roller 20 and drive roller 22, all of which are mounted rotatably and are in engagement with the belt 10 to advance the belt in the direction of arrow 16. Roller 22 is coupled to motor 24 by suitable means such as a belt drive. Initially a portion of the belt 10 passes through charging station A comprising a corotron 26 having a negative potential applied thereto to provide a relatively high substantially uniform negative potential on the belt. Following charging the photoconductive layer 14, the belt is advanced to exposure station B where an original document 28 is positioned face down on a transparent viewing platen 30. Lamps 32 flash light rays onto the original document 28 which are reflected and transmitted through lens 34 forming a light image thereof on the photoconductive surface 14 to selectively dissipate the charge thereon. This records an electrostatic latent image on the photoconductive surface 14 corresponding to the informational areas contained in the original document 28.

Thereafter the belt 10 advances the electrostatic latent image to development station C wherein a magnetic brush developer roller 36 advances a developer mix comprising toner and carrier granules into contact with an electrostatic latent image. The electrostatic latent image attracts the toner particles from the carrier granules thereby forming a toner powder image on the photoconductive belt. Thereafter, the belt 10 advances the toner powder image to transfer station D where a sheet of support material 38 has been fed by a sheet feeding apparatus in timed sequence so that the toner powder image developed on the photoconductive belt contacts the advancing sheet of support material at transfer station D. Typically, the sheet feeding apparatus includes a feed roll 42 which is in rotational contact with the upper sheet of a sheet in a stack of sheets 44. The feed roll rotates so as to advance the uppermost sheet of a stack into the chute 48. The transfer station includes a corona generating device 50 which sprays ions of suitable polarity onto the back side of the sheet so that the toner powder image are attracted from the photoconductive belt 10 to the sheet 38.

Thereafter, the sheet is transported to fusing station indicated generally by E which permanently affixes the transferred toner powder image to the sheet 38. Typically, fuser E includes a heated fuser roll 52 adapted to be pressure engaged with the backup roller 54 so that the toner powder image is permanently affixed to the sheet 38. After fusing the toner image, the sheet 38 is advanced through guide chute 56 to copy catch tray 58 for removal from the printing machine by the operator. The belt next advances past a preclean corotron 55 to cleaning station F for removal of residual toner and other contaminants such as paper debris.

Figure 2:
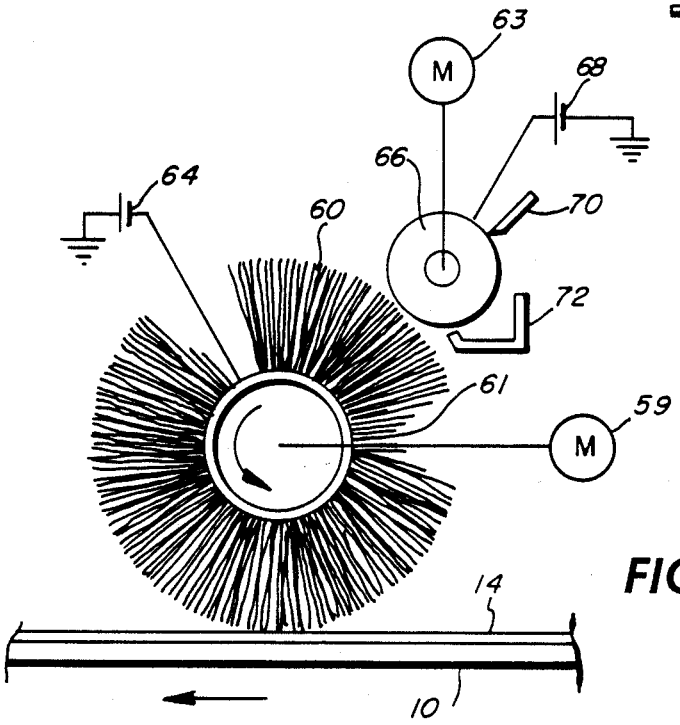
FIG. 2 is a schematic illustration of the electrostatic cleaning apparatus utilized in the machine illustrated in FIG. 1.

As illustrated in FIG. 1 and with additional reference to FIG. 2, cleaning station F comprises an electrically conductive fiber brush 60 which is supported for rotation in contact with the photoconductive surface 14 by a motor 59. A source 64 of negative DC potential is operatively connected to the brush 60 such that an electric field is established between the insulating member 14 and the brush to thereby cause attraction of the positively charged toner particles from the surface 14. Typically, a voltage of the order of negative 250 volts is applied to the brush. An insulating detoning roll 66 is supported for rotation in contact with the conductive brush 60 and rotates at about twice the speed of the brush. A source of DC voltage 68 electrically biases the detoning roll 66 to a higher potential of the same polarity as the brush is biased. A metering blade 70 contacts the roll 66 for removing the toner therefrom and causing it to fall into the collector 72. Typically, the detoning roll 66 is fabricated from anodized aluminum whereby the surface of the roll contains an oxide layer about 50 microns thick and is capable of leaking charge to preclude excessive charge buildup on the detoning roll. The detoning roll is supported for rotation by a motor 63. In the cleaning brush configuration of FIG. 2, the photoconductive belt moves at a speed of about 22.25 inches per second while the brush rotates at a speed of about 30 to 60 inches per second opposite the direction of the photoconductive belt movement. The primary cleaning mechanism is by electrostatic attraction of toner to the brush fibers and being subsequently removed from the brush fibers by the detoning roll from which the blade scrapes the cleaned toner off to an auger which transports it to a sump.

Alternatively, the cleaning device according to the present invention may include the use of a pair of detoning rolls, one for removing toner from a biased cleaner brush and the other removing debris such as paper fibers and clay from the brush in the manner previously discussed with regard to U.S. Pat. No. 4,494,863 to Laing. In this technique the two detoning rolls are electrically biased so that one of them attracts toner from the brush while the other one attracts debris. As a result the toner can be reused without degradation of copy quality while the debris can be discarded.

The cleaning brush according to the present invention is made from a unique electroconductive fiber which provides long cleaning life and substantially no abrasive damage or filming of the imaging surface. In particular, the individual brush fibers comprise a nylon filamentary polymer substrate having finely divided electrically conductive particles of carbon black suffused through the surface of the filamentary polymer substrate and being present inside the filamentary polymer substrate as a uniformly dispersed phase of the polymer substrate in an annular region located at the periphery of the filament and extending inwardly along the length thereof. The electrically conductive carbon black particles are present in an amount sufficient to render the electrical resistance of the fibers from about $1\times10^3$ ohms per centimeter to about $1\times10^9$ ohms per centimeter. As a result of the concentration of conductive carbon black on the outer portion of the fibers, the individual fibers have a generally nonconductive core portion with a thinner outer portion of conductive carbon containing nylon having a resistance per unit length in the stated range. As a result of the structure this value reflects the resistance per unit length of the periphery and provides a resistance per unit length of from about $2\times10^3$ ohms per centimeter to about $1\times10^5$ ohms per centimeter for 40 filament yarn. Preferably, the resistance per unit length of one filament is from about $1\times10^5$ to about $5\times10^6$ ohm per centimeter in maintaining manufacturing control of the properties.

The electrically conductive textile fibers which are useful in the present invention may be made according to the techniques described in U.S. Pat. Nos. 3,823,035 to Sanders and 4,255,487 also to Sanders. In addition, commercially available fibers prepared according to those techniques may be available from BASF Corporation under the designation F901 Static Control Yarn. These fibers, which are made by a process described as suffusion, are to be distinguished from fibers having a conductive coating on the outer surface thereof. The fibers according to the present invention have a layer wherein the electrically conductive carbon black particles have spread through or defused into the fiber substrate itself. As a result, a very durable electroconductive outer portion on the fibers is present. Attention is directed to the forementioned two patents to Sanders for details concerning the fabrication of such fibers. Briefly, however, they are prepared by applying to the nylon filamentary polymer substrate a dispersion of the finely divided electrically conductive particles such as carbon black in a solvent for the filamentary polymer substrate which does not dissolve or react with the conductive particles and removing the solvent from the filamentary polymer substrate after the carbon black particles have penetrated the periphery of the filamentary polymer substrate and before the structural integrity of the filamentary polymer substrate has been destroyed. Typically, formic acid is used as a solvent in the application of carbon black particles to either nylon 6 or nylon 66. Alternatively, in the modified method described by both Sanders patents the dispersion may contain powdered nylon. The fibers have sufficient elastic properties that they do not flex fatigue. Accordingly, with repeated deformation by contact with the imaging member they retain their original configuration. Since the suffusion process provides an integral composite fiber there is no significant debonding nor is there significant abrasive wear of the fibers.

The cleaning brush may be used in any suitable configuration. Typically, a cylindrical fiber brush comprising a spirally wound conductive pile fabric strip on a elongated cylindrical core in the manner illustrated in FIGS. 1 and 2 is used. Typically such a core is from about 0.5 inch to about 3 inches in diameter and is composed of cardboard, epoxy or a phenolic impregnated paper, extruded thermoplastic material or metal providing the necessary rigidity and dimensional stability for the brush to function well during its operation. While the core may be either electrically conductive or nonconductive, it is preferred that it be electrically insulating.

Typically, the cleaning brush has an outside diameter of 1 to 3 inches with a pile height of $\frac{1}{4}$ of an inch to 1 inch. Preferably in high speed process, about $\frac{3}{4}$ of an inch is required to enable suitable interference between the photoreceptor surface and the brush and the detoning roll or rolls and the brush without significant setting of the fibers. The fiber fill density is of the order of 20,000 fibers to 50,000 fibers per square inch preferably 25,000 to 35,000 of from about 5 to about 25 denier per filament fiber preferably 10 to 17 in the center portion of the fabric strip for optimum cleaning performance. The 5 denier per filament fiber provides a fiber diameter of about 25 to 27 microns and the 25 denier per filament provides a fiber diameter of about 52 to 55 microns. In this regard the suffusion treatment results in a diameter increase of about 2 to 5 microns. The pile height of the brush may be from about 6 millimeter to about 20 millimeters and is preferably from about 14 to 18 millimeters in providing optimum high process speed cleaning performance.

Figure 3:
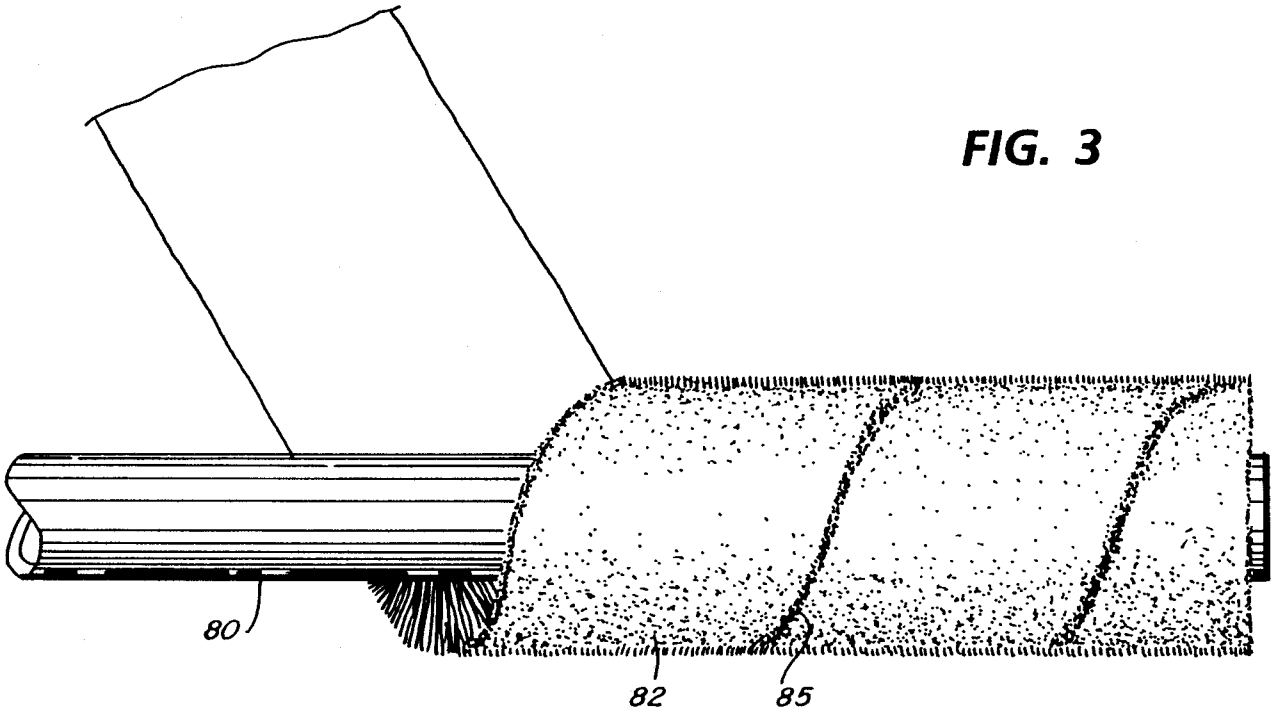
FIG. 3 is an isometric illustration of a cylindrical fiber brush according to the present invention.

FIG. 3 is a schematic illustration of a spirally wound conductive pile fabric strip on a cylindrical core 80 with a cut plush pile woven fabric strip 82 spirally wound about the core.

The cylindrical fiber brush according to the present invention may be fabricated using conventional techniques that are well known in the art. For example, it can be prepared by conventional knitting or tuft insertion processes as well as the preferred weaving process. The initial step of weaving fabric is accomplished from conventional techniques wherein it can be woven in strips on a narrow loom, for example, or be woven in wider strips on a wide loom leaving spaces between the strips. Alternatively, a plush pile woven fabric is produced such that the fiber fill density of the fabric strip at the strip edges is a least double the fiber fill density in the center portion of the fabric strip in the manner described in my U.S. Pat. No. 4,706,320 granted Nov. 17, 1987.

Figure 4:
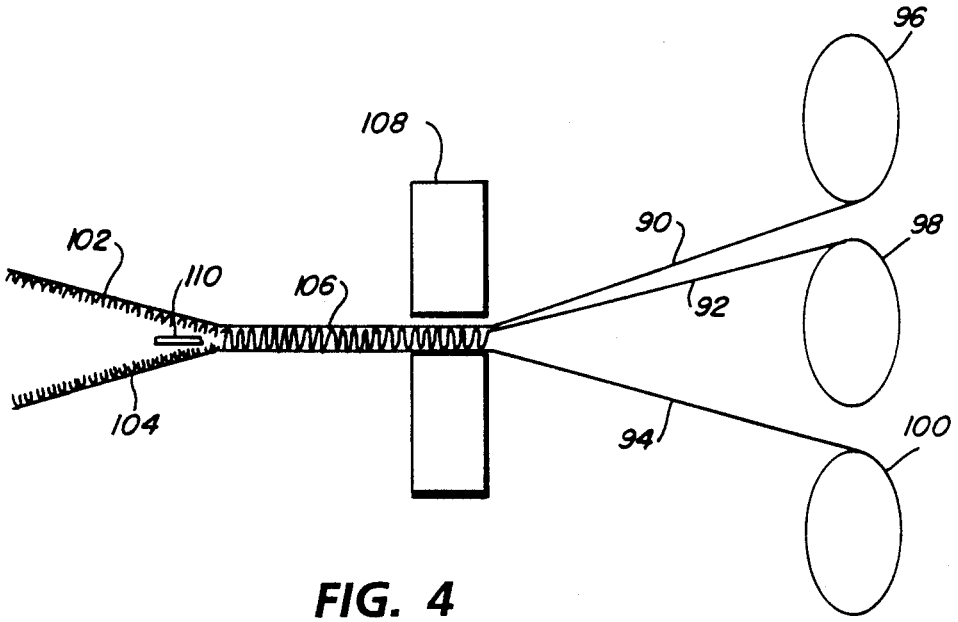
FIG. 4 is a schematic illustration of a conventional weaving system.

FIG. 4 schematically illustrates a conventional weaving apparatus where fabrics can be made using any suitable shuttle or shuttleless pile weaving loom. A woven fabric is defined as a planar structure produced by interlacing two or more sets of yarns whereby the yarns pass each other essentially at right angles. A narrow woven fabric is a fabric of 12 inches or less in width having a selvage edge on either side. A cut pile woven fabric is a fabric having pile yarns protruding from one face of the backing fabric where the pile yarns are cut upon separation of two symmetric fabric layers woven at the same time.

A general explanation of the weaving process is described below with reference to FIG. 4. In a preferred embodiment, a lubricant is applied as a fiber finish to the fibers at a suitable post suffusion stage in the manufacture of the brush to enhance high speed yarn handling characteristics. Typically, the lubricant may be applied prior to or during weaving or during brush shearing. Typically, materials that may be used as fiber finishes include mineral oils, hydrocarbon oils, silicones and waxes. Preferred commercially available materials include Stantex finishes, blends of mineral oil, fatty esters, non-ionic emulsifiers and low sling additives available from Henkel Corporation, Charlotte, N.C. and Permafin 206 a water emulsion of a fatty ethylenic copolymer available from National Starch & Chemical Company, Salsbury, N.C.. In addition to assisting in the fabricating process this treatment has the effect of reducing friction to minimize entanglements during use. Accordingly, the fiber to fiber, fiber to detoning roll, fiber to imaging member friction is reduced and radial shrinkage of the brush and detoning performance maintained to reduce the possibility of cleaning failure. Warp yarns for upper backing 90, lower backing 94, and pile 92 are wound on individual loom beams 96, 98 and 100. All yarns on the beams are continuous yarns having lengths of many hundreds of thousands of yards and are arranged parallel to each other to run lengthwise through the resultant pile fabric. The width of the fabric, the size of warp yarns, and the number of warps "ends" or yarns per inch desired in the final fabric will govern the total number of individual warp yarns placed on the loom beams and threaded into the loom. From the loom beams, the yarns feeding the upper backing fabric 102, the lower backing fabric 104, and the pile 106 are led through a tensioning device, usually a whip roll and lease rods and fed through the eyes of heddles and then through dents in a reed 108. This arrangement makes it possible to manipulate the various warp yarns into the desired fabrics. As the warp yarns are manipulated by the up and down action of the heddles of the loom, they separate into layers creating openings called sheds. The shuttle carries the filling yarn through the sheds thereby forming the desired fabric pattern. The woven fabric having both an upper and lower backing 102, 104 with a pile 106 in between is cut into two fabrics by a cutter 110 to form two cut plush pile fabrics. A particularly preferred fabric is a cut plush pile woven fabric. Following weaving if the fabric has been woven on a wide loom leaving spaces between adjacent strips the fabric may be slit into strips by slitting the woven backing between the pile strips. Following the weaving techniques the fabric strips are coated with a conductive latex such as Emerson Cumming's Eccocoat SEC which is thereafter dried by heating. Thereafter the fabric strip is slit to the desired width dimension making sure not to cut into the pile region but coming as close to it as possible by conventional means such as by hot knife slitter, or by ultrasonic slitter.

The fabric strip is spirally wound onto the fabric core and held there with an adhesive to bind the fabric to the core. The width of the strip is dictated by the core size, the smaller cores generally require narrower fabric strips so it can be readily wrapped. The adhesive applied may be selected from readily available epoxy, hot melt adhesives, or may include the use of double backed adhesive tape. In the case of liquid or molten adhesives, they may be applied to the fabric alone, to the core alone or to both and may be conductive or non-conductive. In the case of double backed tape, it is typically applied to the core material first. The winding process is inherently imprecise in that there is an inability to control the seam gap between fabric windings. This is because the fabric responds differently to tension by way of stretching, deforming or wrinkling. The fabric strip is wound in a constant pitch winding process whereby the spiral winding angle is based upon a knowledge of the core diameter and the fabric width. Typically, the core circumference is projected as a length running diagonally on the fabric from one edge to the other, and the winding angle is derived by this diagonal and the perpendicular between the two fabric edges.

Figure 5:
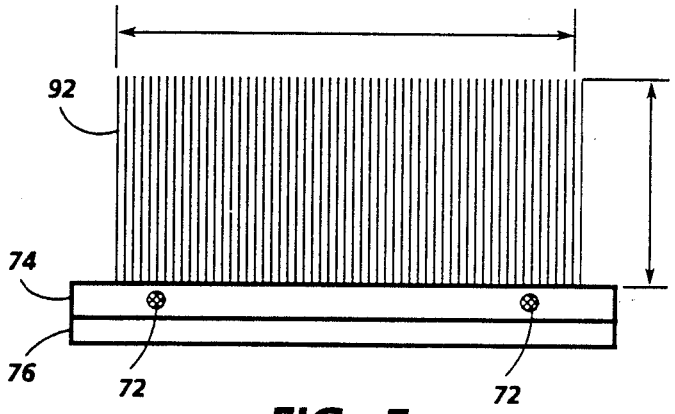
FIG. 5 is a schematic cross section of a fabric with highly conductive yarns in the fabric backing and a conductive latex back coating.

FIG. 5 illustrates an alternative embodiment of the fabric strip construction which may be used to assure a more functionally uniform bias to filament ends of the brush. In this embodiment, highly conductive fibers 72 having metallic conductivity such as stainless steel are woven into the backing 74, for example polyester, of the fabric about 2 to 3 centimeters apart across the length of the fabric strip. Also illustrated is the conductive synthetic latex coating 76. When the strip is wound on the core, the presence of the highly conductive stainless steel yarns assures a continuous low resistance path along the length of the brush. This is helpful because in some applications the electrostatic cleaning brush may have the appropriate bias applied at one end only, the other end being electrically floating. With the more conductive stainless steel yarns in contact with the more resistive conductive backings and many of the conductive pile fibers 92 a more functionally uniform bias to the filament ends of the brush is assured.

The present invention may be better understood by reference to the following examples wherein unless otherwise specified all parts and percentages are by weight.

EXAMPLE I

A xerox 1075 duplicator was retrofitted with an electrostatic brush cleaning device with two detoning rolls as described in U.S. Pat. 4,494,863 to Laing. The cylindrical cleaning brush was 2.84" outside diameter and comprises of an insulating core of a phenolic impregnated paper having an electroconductive nylon fiber woven into a polyester backing fabric coated with an electroconductive synthetic latex. The pile yarns were electroconductive fibers of 15 denier nylon 6 monofilament fibers having a circular cross sectional diameter of about 42 to 45 microns which had been passed through a dispersion of finely divided conductive black particles in a formic acid solvent dispersion to suffuse the conductive carbon black particles and nylon 6 polymer through the surface of the filamentary polymer substrate thereby providing a generally uniform dispersion of particles of carbon black in an annular region along the length of the filament. The resulting fibers comprise a central, nonconductive nylon core with a relatively thin portion surrounding the core of conductive carbon containing nylon and a resistance per unit length of $1\times10^4$ to about $9\times10^4$ ohms per centimeter for a 40 filament yarn. By comparison, the untreated filament has a resistance of greater than $10^{14}$ohm per centimeter. The treated fibers were 17 denier per filament and were woven as a 40 filament yarn providing a yarn denier of about 700 into a polyester backing. Prior to weaving, the multifilament yarn first had a Stantex lubricant applied to facilitate high speed twisting operation and then were twisted a minimum of two turns per inch to maintain yarn integrity during processing and handling. After twisting the yarn was heat set using a vacuum autoclave at 250° F. The resulting fabric had a pile density of 30,000 filaments per square inch. The cleaning brush was operated at process speed of 30 inches per second against a photoreceptor speed of 15 inches per second. During operation, a bias of negative 200 volts DC was continously applied to the electrostatic cleaning brush. More than 1,000,000 impressions were successfully cleaned following transfer of the toner image to copy sheets without significant change in the performance and the brush was still operating successfully when a test was terminated at the completion of 1,000,000 impressions.

EXAMPLES II AND III

Two additional brushes prepared in the same manner were tested in a similar electrostatic brush cleaner on a prototype duplicating apparatus. During testing the process speed of the cylindrical electrostatic cleaning brush was 30 inches per second while the process speed of the photoreceptor was increased to 22 inches per second and a bias of negative 200 volts DC was applied to the electrostatic cleaning brushes. One brush continued to clean effectively after 1.3 million impressions had been made without failure and the other brush continued successfully after 1.4 million impressions had been cleaned without failure.

As a result of the fibers useful in the present invention having a central non-conductive core of nylon with a thin otuer portion of conductive carbon containing nylon, when woven into a fabric and having a conductive backing applied, any bias applied at one end of the cylindrically wound brush can be transmitted through the brush to the filament ends because of the intimate contact between conductive portions of the composite fiber. In other words, by having the conductive portions of the composite fiber on the outside, it is capable of transmitting the applied bias to the filament ends by the intimate contact between adjacent portions of conductive poritions of the fiber. If the reverse were true wherein the core of the fiber were the conductive portion, the bias could only be transmitted by the individual fibers and not by the intimate individual fiber contact. Furthermore, according to the present invention with an unfilled core, the fiber will maintain its strength and not be weakened by the addition of non-reinforcing but conductive fillers used to give it conductivity. In addition, the fibers according to the present invention have sufficient structural strength to withstand processing. The high breaking strength of the fiber is not significantly altered by the presence of the carbon black. In addition, the fibers useful in the practice of the present invention have sufficient stiffness to function in the cleaning operation, that is to return to their initial position but not be so stiff as to damage the imaging surface. Typically, the modulus is of the order of 150,000 to 600,00 psi. The fibers have the further advantage in that they tend to stay relatively clean and not to be impacted by toner or to significantly film the photoreceptor. Thus, according to the present invention, relatively inexpensive, conductive fibers are provided for electrostatic cleaning brushes which are relatively inexpensive and enormously long lasting and capable of fabricated into brushes using standard manufacturing techniques.

The patents and applications referred to herein are hereby specifically and totally incorporated in the instant application in their entirety by reference thereto.

While the invention has been described with reference to specific and preferred embodiments, it will be appreciated that various modifications and variations will be apparent to the artisan. For example, while the electrostatic cleaning apparatus has been described as being a rotatable cylindrical brush member, it will be understand that the electrostatic cleaning brush may be in the form of a belt, web or pad. Accordingly, it is intended that all such modifications and embodiments that may readily occur to one skilled in the art are intended to be within the scope of the appended claims.

I claim:

1. A cleaning brush for use in an electrostatographic reproducing apparatus comprising electroconductive fibers, said individual brush fibers comprising a filamentary polymer substrate having finely divided electrically conductive particles of carbon black suffused through the surface of the filamentary polymer substrate and being present inside the filamentary polymer substrate as a uniformly dispersed phase independent of the polymer substrate in an annular region located at the periphery of the filament and extending inwardly along the length thereof, the electrically conductive carbon black being present in an amount sufficient to render the electrical resistance of the fiber from about $1\times10^3$ ohms/cm to about $1\times10^9$ ohms/cm.

2. The cleaning brush of claim 1 wherein said fibers are the cut plush pile of a cut plush pile woven fabric.

3. The cleaning brush of claim 2 further comprising an elongated cylindrical core having bound thereto said cut plush pile woven fabric.

4. The cleaning brush of claim 3 wherein said fabric is a fabric strip spirally wound and bound to said cylindrical core, said fabric strip including highly conductive yarns spaced about 2 to 3 cm apart running substantially parallel to the strip edges.

5. The cleaning brush of claim 4 wherein said fabric further includes an electrically conductive backing.

6. The cleaning brush of claim 5 wherein said brush has a fiber fill density of from about 20,000 to about 50,000 fibers per square inch of from 5 to about 25 denier per filament fibers and a pile height of from about 6 to about 20 mm.

7. The cleaning brush of claim 1 wherein the polymer substrate is nylon.

8. Apparatus for cleaning an electrostatographic imaging member residual toner comprising a cleaning brush comprising electroconductive fibers, said individual brush fibers comprising a nylon filamentary polymer substrate having finely divided electrically conductive particles of carbon black suffused through the surface of the filamentary polymer substrate and being present inside the filamentary polymer substrate as a uniformly dispersed phase independent of the polymer substrate in an annular region lcoated at the periphery of the filament and extending inwardly along the length thereof, the electrically conductive carbon black being present in an amount sufficient to render the electrical resistance of the fiber from about $1\times10^3$ ohm/cm to about $1\times10^9$ ohm/cm, means for electrically biasing said brush to a polarity opposite to that of the charge on said toner and means to provide moving contact of said brush fiber with said imaging member whereby said toner is attracted to said brush when said brush contacts said imaging member.

9. The cleaning apparatus of claim 8 wherein said fibers are the cut plush pile of a cut plush pile woven fabric.

10. The cleaning apparatus of claim 9 further comprising an elongated cylindrical core having bound thereto said cut plush pile woven fabric.

11. The cleaning apparatus of claim 10 wherein said fabric is a fabric strip spirally wound and bound to said cylindrical core, said fabric strip including highly conductive yarns spaced about 2 to 3 cm running substantially parallel to the strip edges.

12. The cleaning apparatus of claim 11 wherein said fabric further includes an electrically conductive backing.

13. The cleaning apparatus of claim 12 wherein said brush has a fiber fill density of from about 20,000 to about 50,000 fibers per square inch of from 5 to about 25 denier per filament fibers and a pile height of from about 6 to about 20 mm.

14. The cleaning apparatus of claim 8 wherein the polymer substrate is nylon.

* * * * *